US009644411B2

(12) United States Patent
Gompper

(10) Patent No.: US 9,644,411 B2
(45) Date of Patent: May 9, 2017

(54) ADJUSTABLE HINGE

(71) Applicant: Brion Gompper, Lakewood, NJ (US)

(72) Inventor: Brion Gompper, Lakewood, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 791 days.

(21) Appl. No.: 13/760,593

(22) Filed: Feb. 6, 2013

(65) Prior Publication Data

US 2014/0215923 A1 Aug. 7, 2014

(51) Int. Cl.

| | |
|---|---|
| ***E05D 7/00*** | (2006.01) |
| ***E05D 7/04*** | (2006.01) |
| *E05D 5/10* | (2006.01) |

(52) U.S. Cl.

CPC ..... *E05D 7/0054* (2013.01); *E05D 7/04* (2013.01); *E05D 5/10* (2013.01); *E05D 2005/108* (2013.01); *E05D 2007/0063* (2013.01); *E05D 2007/0484* (2013.01); *E05Y 2201/11* (2013.01); *E05Y 2600/624* (2013.01); *Y10T 16/532* (2015.01)

(58) Field of Classification Search

USPC .... 49/381, 396, 397; 16/235, 236, 237, 242, 16/247, 249, 250, 251, 240, 245

See application file for complete search history.

(56) References Cited

U.S. PATENT DOCUMENTS

| | | | | |
|---|---|---|---|---|
| 2,027,888 | A * | 1/1936 | Solomon | 16/249 |
| 2,839,778 | A * | 6/1958 | Hutchinson et al. | 16/245 |
| 3,748,688 | A * | 7/1973 | Berkowitz | 16/247 |
| 3,748,689 | A * | 7/1973 | Grunert | 16/237 |
| 3,772,735 | A * | 11/1973 | Lautenschlaeger | 16/237 |
| 3,909,879 | A * | 10/1975 | Grunert et al. | 16/245 |
| 4,407,044 | A * | 10/1983 | Iseki | 16/237 |
| 5,144,721 | A * | 9/1992 | Schade | 16/237 |
| 5,788,351 | A * | 8/1998 | Prunty et al. | 312/326 |
| 6,721,992 | B2 * | 4/2004 | Cotton | 16/251 |
| 7,945,996 | B2 * | 5/2011 | Gunderson | 16/312 |
| 8,011,064 | B2 * | 9/2011 | Leimkuehler et al. | 16/251 |
| 2003/0009850 | A1 * | 1/2003 | Kincaid | 16/250 |
| 2003/0233731 | A1 * | 12/2003 | Cotton | 16/250 |
| 2010/0125970 | A1 * | 5/2010 | Leimkuehler et al. | 16/251 |
| 2012/0102674 | A1 * | 5/2012 | King et al. | 16/237 |
| 2012/0204492 | A1 * | 8/2012 | Berger | 49/399 |

FOREIGN PATENT DOCUMENTS

| | | | | |
|---|---|---|---|---|
| DE | 3217130 | A1 * | 12/1982 | E05D 7/04 |
| DE | 3435161 | A1 * | 4/1986 | E05D 5/02 |
| JP | 04070480 | A * | 3/1992 | E05D 7/04 |
| JP | 05222878 | A * | 8/1993 | E05D 7/04 |
| WO | WO 9015912 | A1 * | 12/1990 | E05D 11/00 |

* cited by examiner

*Primary Examiner* — Jerry Redman

(74) *Attorney, Agent, or Firm* — Francis C. Hand; Carella, Byrne et al.

(57) ABSTRACT

The hinge has a bracket for mounting on a door frame, an adjusting plate for securement to a door, a flange pivotally mounted on the bracket and disposed over the adjusting plate and captive nut assemblies for securing the flange to the adjusting plate in a releasable longitudinally adjustable manner. Loosening of the captive nut assemblies allows the door to be moved laterally of the frame before tightening of the captive nut assemblies fixes the door relative to the frame.

16 Claims, 5 Drawing Sheets

ADJUSTABLE HINGE

This application relates to an adjustable hinge. More particularly, this invention relates to an adjustable hinge for a walk-in cooler or freezer.

As is known, the walk-in coolers and freezers have doors that are mounted in frames so as to open and close by pivoting relative to the door frames. Typically, one or more hinges are provided to accommodate the pivoting motion of the door. In some cases, the hinges are made of a bracket that is secured to the door frame, for example, by screws, and a flange that is secured to the door, for example by screws, and pivotally mounted on the bracket. In these situations, the doors have frequently been provided with pre-formed holes in order to receive the screws for mounting of the flanges to the door.

Generally, the doors and frames of walk-in coolers are aligned and assembled in a factory as a unit prior to field installation. As a result, in many cases, there are resultant miss-alignments of a door and frame when field installed. Due to the methods employed to field assemble a walk-in, it is imperative the structure be level, plumb, and square for proper completion of the walk-in. Unfortunately, this is rarely achieved and one result is the misalignment of the door with respect to the frame. This misalignment causes various issues in daily operation of the walk-in inclusive of loss of internal temperature control, door gasket wear, and door locking alignment.

Further, over time, door "sag" or misalignments of door and frame occur due to use, abuse, and wear. U.S. Pat. No. 7,870,642 describes a hinge that is intended to compensate for sag or misalignment of walk-in type refrigerator and freezer doors. As described, the hinge is constructed with a strap assembly adapted to be mounted to a door and pivotally coupled to a mounting flange wherein the strap assembly has a strap with a plurality of screw openings, an adjustment bracket having a plurality of screw openings alignable with the strap screw openings and a lateral adjuster which causes lateral relative movement between the strap and the adjustment bracket, whereby the door is adjusted relative to a jamb by movement of the lateral adjuster that causes lateral relative movement between the strap and the adjustment bracket. However, in the case of a need to adjust a gap between a door and a door jamb, the described construction requires a user to manipulate the lateral adjuster against the weight of the door. That is, as described, the lateral adjuster includes flanges on the strap and adjustment bracket and a threaded bolt coupled to one flange and threadably coupled to the other flange whereby threaded movement of the threaded bolt causes relative movement between the flanges, and thereby relative movement between the adjustment bracket and the strap.

Other adjustable hinges are also known from U.S. Pat. No. 4,407,044.

In some instances, the doors of coolers are mounted in a door frame so that there is a gap between the side edge of the door and the frame. In cases where the doors have been pre-formed with holes to receive mounting screws, the typical hinge that would otherwise be used to hinge the door to the frame cannot be used without the need to drill or otherwise form a new set of holes in the door to receive the flange of the hinge.

Typically, there is a gasket affixed to the outer surface edges of the door of a walk-in cooler to ensures that a complete seal be achieved between door and frame when the door is in a closed position. As gasket shapes vary by manufacturer and door type, there is frequently a need to adjust the mounting of the door to the frame after a gasket has been installed on the door.

Accordingly, it is an object of the invention to provide a hinge that can be adjusted to a door formed with pre-formed holes for receiving mounting screws for the hinge.

It is another object of the invention to provide a hinge that can be adjusted in a simple manner for mounting a door in a frame.

It is another object of the invention to be able to adjust a gap between a door and a door jamb of a walk-in cooler without working against the weight of the door.

It is another object of the invention to provide a hinge for a walk-in cooler that provides a quick, simple and safe means to reestablish a proper fit of the door of the cooler to the frame of the cooler.

It is another object of the invention to be able to adjust the mounting of a door to a frame upon replacement of a door gasket in a simple reliable manner.

Briefly, the invention provides an adjustable hinge comprising a bracket for mounting on a door frame, a flange pivotally mounted on the bracket for mounting on a door and an adjusting plate for mounting on the door and on which the flange may be adjustably mounted longitudinally of the plate.

The hinge also includes a simple means for securing the flange to the adjusting plate in a releasable manner to allow manual adjustment of the flange relative to the adjusting plate without removal of the flange from the adjusting plate.

The bracket is constructed with bores through which mounting elements, such as screws, may pass into a door frame in order to secure the bracket to the door frame.

The adjusting plate is constructed with a plurality of bores for passage of similar mounting elements therethrough into holes that are pre-formed in the door as well as a plurality of elongated slots disposed longitudinally of the plate and in parallel relation to each other.

In accordance with the invention, in order to provide for an adjustment of the flange relative to the adjusting plate, the means for securing the flange to the adjusting plate employs a plurality of captive nut assemblies in the hinge. In addition, the adjusting plate has a plurality of elongated slots disposed longitudinally of the plate and in parallel relation to each other while the flange has a plurality of bores in alignment with the slots of the adjusting plate. Each captive nut assembly has a nut that passes through a slot in the plate from the underside of the plate and is slidably disposed in the slot and a screw that passes through a bore in the flange and is threadably mounted in the nut. Upon threading into and tightening of the screw in the nut, the flange becomes clamped to the plate.

In instances where there is a need to form a gap between the side edge of a door and a door frame, the captive nut assemblies are loosened so that the door with the adjusting plate fixed thereon can be manually shifted away from the door frame to create a gap of desired width. Thereafter, the captive nut assemblies are re-tightened to fix the door in place.

The adjustable hinge also has a cover plate that is removably mounted on the flange on a side opposite the adjusting plate in order to protect against a loss of the screws of the captive nut assemblies should these screws become inadvertently loosened and to provide a pleasing aesthetic appearance to the exterior of the flange.

The adjustable hinge also has a cam assembly mounting the flange on the bracket in order to aid in establishing a proper offset of the hinge with respect to the door design, to allow rotation of the door with respect to the frame and to lift the door while being opened and to lower the door back into position when the door is being closed.

These and other objects and advantages of the invention will become more apparent from the following detailed description taken in conjunction with the accompanying drawings wherein.

Figure 1:
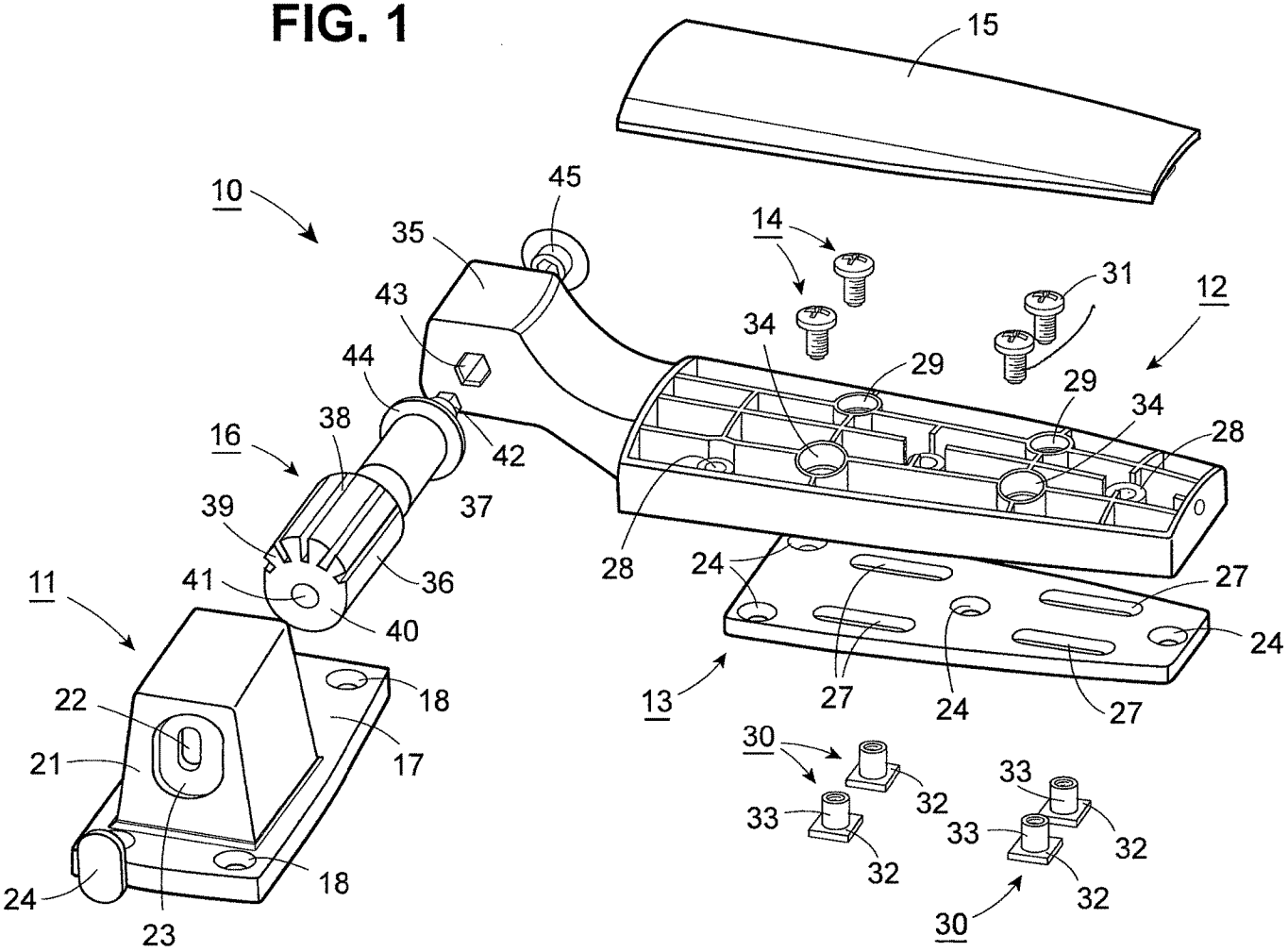
FIG. 1 illustrates an exploded view of an adjustable hinge in accordance with the invention.

Referring to FIG. 1, the adjustable hinge 10 comprises a bracket 11, a flange 12, an adjusting plate 13, a plurality of captive nut assemblies 14, a cover plate 15 and a cam assembly 16.

Figure 2:
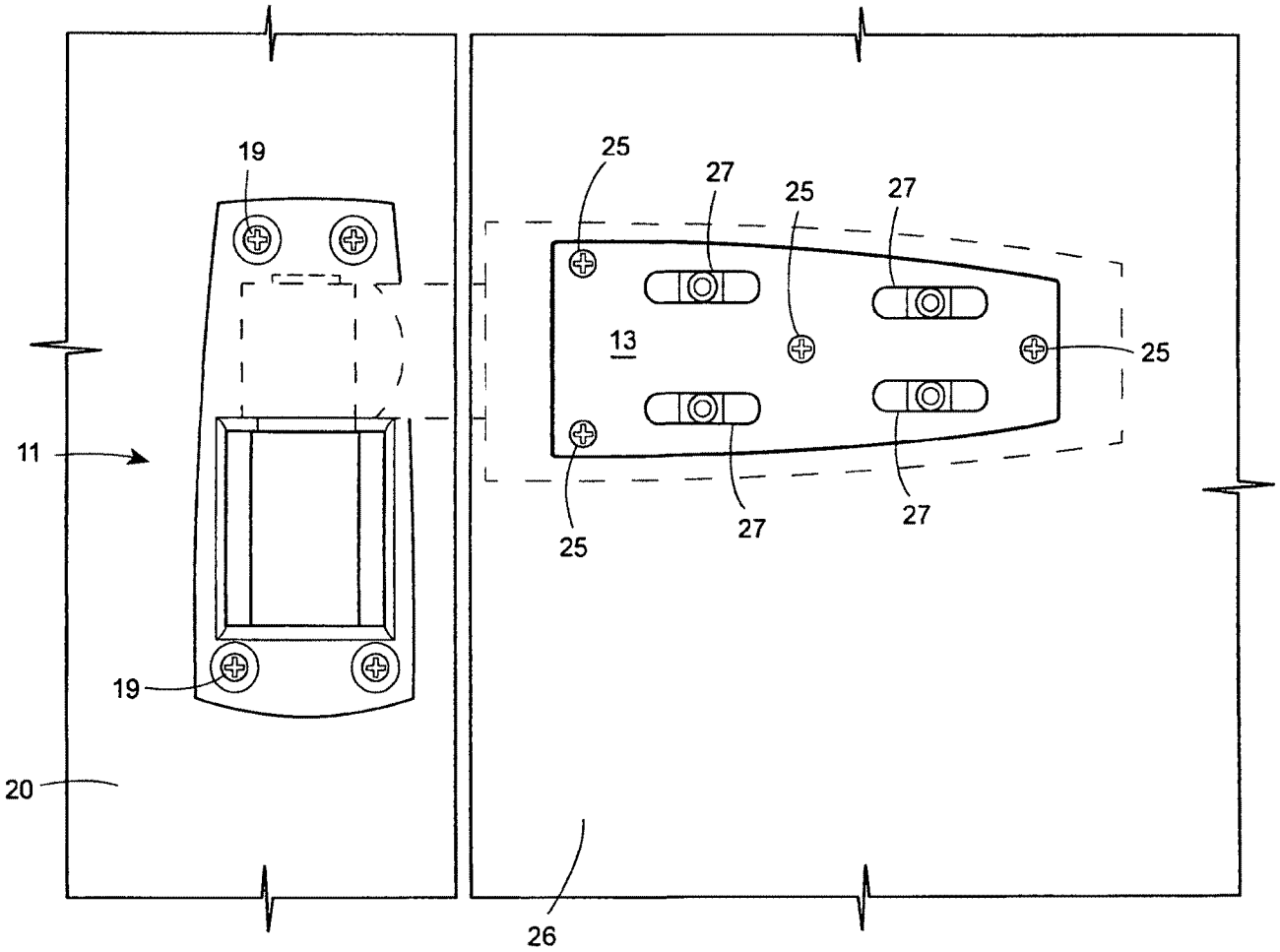
FIG. 2 illustrates a front view of a door with the adjusting plate of the hinge of FIG. 1 fixed in place and a door frame with the bracket of the hinge of FIG. 1 fixed in place.

Referring to FIGS. 1 and 2, the bracket 11 has a base 17 with a plurality of bores 18, e.g. four bores at the corners, for receiving mounting elements, such as screws 19 for securing the bracket 11 to a door frame 20. The bracket 11 also has a block 21 outstanding from the base 17 that is provided with a bore (not shown) for receiving the cam assembly 16. An elongated slot 22 is provided in a recess 23 in a back wall of the block 21 for purposes as explained below and an oval cover 24 is provided to close over the slot 22 and to fit within the recess 23.

Referring to FIGS. 1 and 2, the adjusting plate 13, as shown, is of trapezoidal shape but may be made of any suitable shape. The adjusting plate 13 includes a plurality of bores 24, e.g. four bores, for receiving mounting elements, such as screws 25 for securing the plate 13 to a door 26. In addition, the adjusting plate 13 has a plurality of elongated slots 27, e.g. four slots, that are disposed longitudinally of the plate 13 and in parallel relation to each other.

Figure 3:
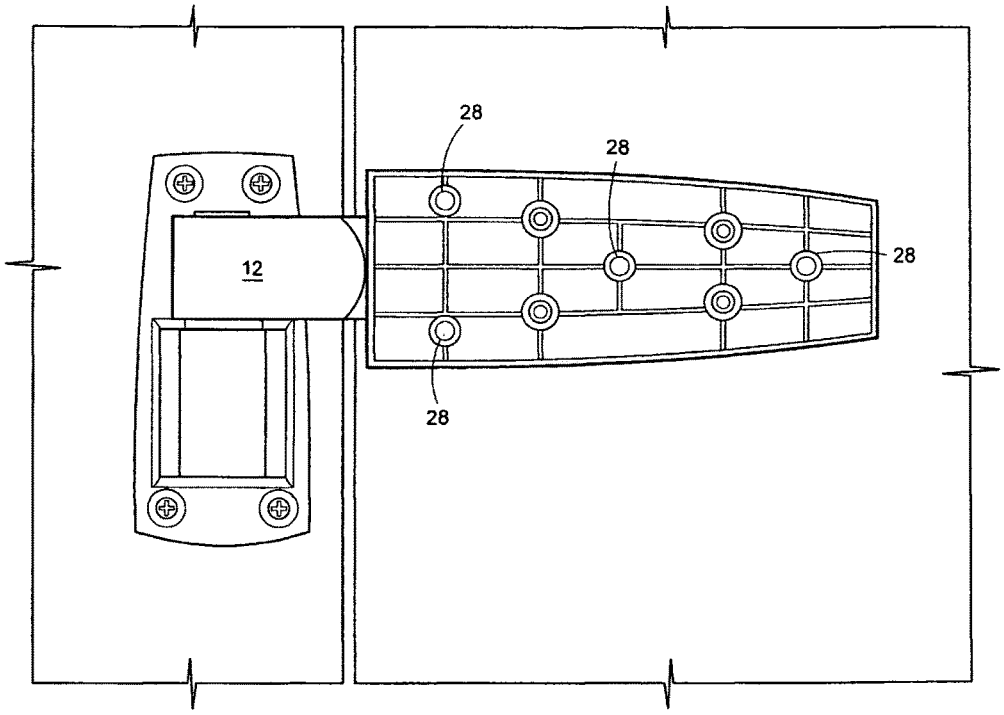
FIG. 3 illustrates a view similar to FIG. 2 with the flange of the hinge of FIG. 1 secured to and over the adjusting plate.

Referring to FIGS. 1 and 3, the flange 12 is pivotally mounted on the bracket 11 via the cam assembly 16 and has a plurality of bores 28, e.g. four bores, for passage of mounting elements, such as screws, therethrough into the door 26. When the flange 12 is to be mounted on the door 26 without the need for adjustment and without the adjusting plate 13, the screws 25 otherwise used for securing the adjusting plate 13 to the door 26 may be used to secure the flange 12 directly to the door 26.

When the flange 12 is to be mounted on the door 26 with a need for adjustment and with the adjusting plate 13, the bores 28 in the flange 12 are not utilized.

The flange 12 is also provided with a set of bores 29, e.g. four bores, that are aligned with the slots 27 in the adjusting plate 13.

Referring to FIGS. 1 and 3, each captive nut assembly 14 functions as a simple means for securing the flange 12 to the adjusting plate 13 in a releasable manner to allow manual adjustment of the flange 12 relative to the adjusting plate 13 without a need to remove the hinge 10 from the door/frame. As illustrated, each captive nut assembly 14 includes an internally threaded nut 30 that passes through a slot 27 in the plate 13 from the underside of the plate 13 and a screw 31 that passes through a bore 29 in the flange 12 into threaded engagement with the internal nut 30.

As illustrated in FIGS. 1 and 3, each nut 30 has a flat rectangular base 32 and an internally threaded cylinder 33 upstanding from the base 32. The cylinder 33 is of a diameter to pass through a slot 27 in the adjusting plate 13 so that each captive nut assembly 14 is slidably disposed in a slot 27 of the plate 13 while the base 32 is sized to be larger than the width of a slot 27.

Each screw 31 of a captive nut assembly 14 has a head that is received within a recess 34 in the flange 12 and a stem that passes through a bore 29 and into threaded engagement with the cylinder 33 of an internal nut 30. Upon threading into and tightening of a respective screw 31 in a nut 30, the flange 12 becomes clamped to the plate 13.

Figure 4:
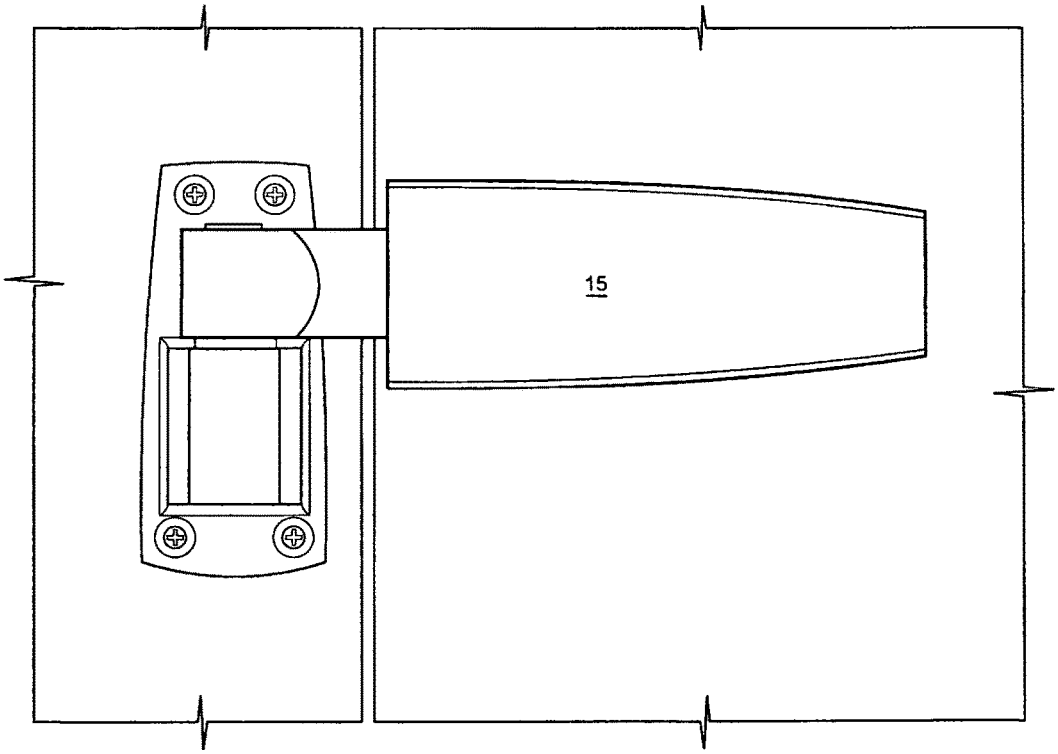
FIG. 4 illustrates a view similar to FIG. 2 with the cover plate of the hinge of FIG. 1 secured to and over the flange.

As illustrated in FIGS. 1 and 4, the cover plate 15 is removably mounted on the flange 12 on a side opposite the adjusting plate 13 in order to protect against a loss of the screws 31 of the captive nut assemblies 14 should these screws become inadvertently loosened and to provide a smooth and pleasing aesthetic appearance to the exterior of the flange 12.

Referring to FIG. 1, the flange 12 has a hub 35 that has a predetermined offset from the remainder of the flange 12 to receive one end of the cam assembly 16. The offset is incorporated into the flange 12 to provide proper mating of the hinge 10 to the frame 20 and door 26. As door and frame configuration can vary in their respective alignments for different walk-in coolers, the predetermined offset may be one which accommodates flush style doors, as well as doors offset by ⅛, ¼, ⅜, 1⅛, 1¼, 1⅜, 1½, 1⅝, 1¾, 1⅞, and 2.00 inches.

The cam assembly 16 includes a female cam 36 mounted in the bracket 11 and a pin 37 secured in the hub 35 of the flange 12.

As illustrated, the female cam 36 has a plurality of longitudinal grooves 38 and ribs 39 that extend about a part periphery of the cam 36 which is otherwise of oval cross-section in order to provide two specific offsets to properly mount the hinge 10 to differing door/frame designs. Providing two different cams 36 allows for four specific offsets to be accommodated. The longitudinal grooves 38 and ribs 39 allow the cam 36 to be "press-fit" into the block 21 of the bracket 11 and, once fit, ensure against movement of the cam 36. The grooves 38 provide a means of uniform compression of the cam 36 in the block 21. The female cam 36 is thus fitted into the bore (not shown) of the block 21 of the bracket 11 in a non-rotatable manner.

As shown, the ribs 39 extend outwardly of a central cylindrical section 40 of the cam 36 and are trapezoidal in cross-section.

The female cam 36 also has a bore 41 passing through the central cylindrical section 39 for purposes as explained below.

The pin 37 is of plastic material with a cylindrical shape at one end to be rotatably mounted in a bore (not shown) of the female cam 36, a stub 42 of polygonal shape at the opposite end that fits into a corresponding bore 43 in the hub 35 of the flange 12 so as to be non-rotatable relative to the flange 12 and a radially extending collar 44 for abutting against the female cam 36 when the pin 37 is inserted in the cam 36 and against the hub 35 when the stub 42 is inserted in the hub 35. The collar 44 thus acts as a slide bearing between the cam 36 and hub 35.

As illustrated, a plug 45 is provided to close the bore 43 in the hub 35.

Removal of the covers 24, 45 allows an optional power spring assist assembly (not shown) to be inserted through the slot 22 in the block 21, aligned bore 41 in the cam 36 and bore 43 in the hub 35. The power spring assist assembly is of conventional structure and need not be further described for an understanding of the hinge 10.

In use, the bracket 11 of the hinge 10 is secured to the door frame 20 and the adjusting plate 13 is secured to the door 26 as indicated in FIG. 2. At this time, the internal nuts 30 are positioned within the slots 27 of the plate 13. In this condition, the nuts 30 are free to slide along the slots 27 with the base 32 of each nut 30 being sandwiched between the door 21 and the plate 13.

Next, as indicated in FIG. 3, the cam assembly 16 is mounted in the block 21 of the bracket 11 with the stub 42 of the cam assembly 16 fitted into the hub 35 of the flange 12. The flange 12 is then located over the adjusting plate 13 and the screws 31 loosely threaded into the nuts 30. In this condition, the door 26 can be moved laterally relative to the frame 20 to adjust the gap therebetween.

After obtaining the desired position between the door 26 and the frame 20, the screws 31 are tightened within the nuts 30 to firmly clamp the flange 12 to the adjusting plate 13.

Thereafter, the cover plate 15 is mounted on the flange 12 as indicated in FIG. 4 so that the door 21 is ready for use.

Figure 5:
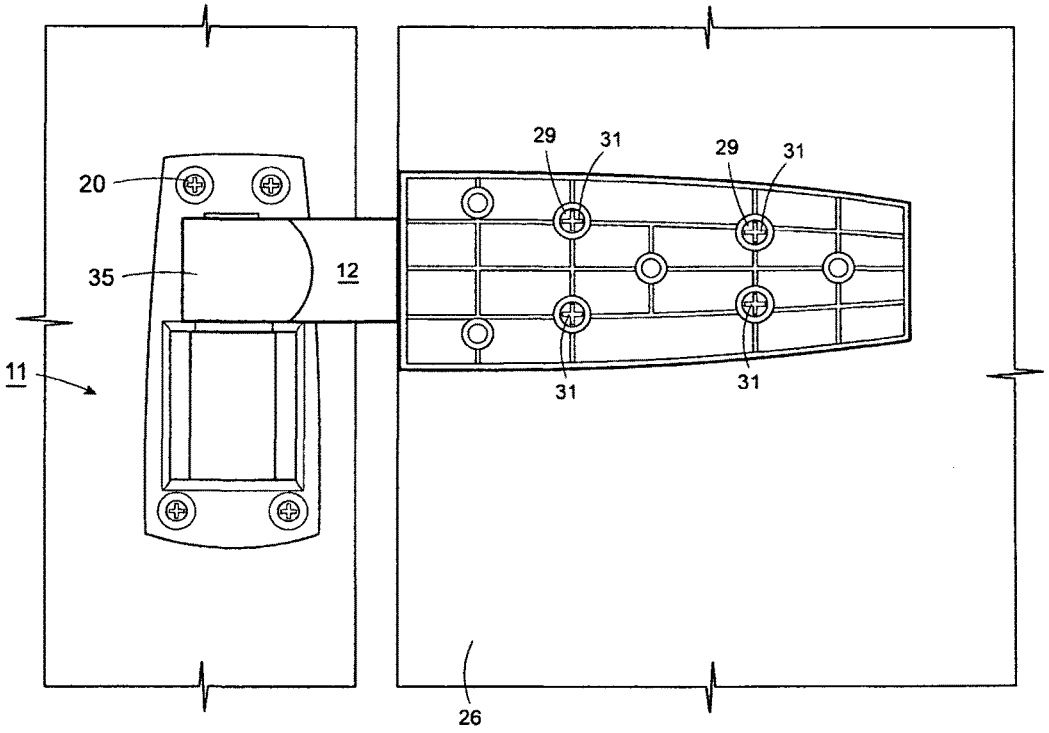
FIG. 5 illustrates a view similar to FIG. 3 with a gap between the side edge of the door and the door frame in accordance with the invention.

Referring to FIG. 5, should there be a need to space the door 26 from the frame 20 to create a gap therebetween, for example, due to replacement of a gasket (not shown) on the door 26, with the flange 12 positioned over the adjusting plate 12 and with the screws 31 of the captive nut assemblies 14 in a loosened state, the door 26 with the adjusting plate 13 affixed thereon is manually moved laterally away from the door frame 20. During this time, the adjusting plate 13 slides along the flange 12 which is otherwise fixed in place as the gap widens. Upon reaching the desired size of gap, the screws 31 are manually tightened to fix the adjusting plate 13 to the flange 12 and, thus the door 21 relative to the door frame 20.

The invention thus provides a hinge that can be adjusted to a door formed with pre-formed holes for receiving mounting screws for the hinge and a hinge that can be adjusted for mounting a door in a frame.

The invention also provides a hinge for a door/frame construction that allows a gap between the door and frame to be adjusted by moving the door manually relative to the frame without a need to remove the hinge from the door or frame.

The invention also provides a hinge for a walk-in cooler that allows a quick, simple and safe means to reestablish proper fit of the door of the cooler to the frame of the cooler, particularly, upon replacement of a door gasket.

The invention provides a hinge that can accommodate movement of a door relative to a door frame to adjust a gap therebetween in a simple manner.

What is claimed is:

1. An adjustable hinge comprising a bracket for mounting on a door frame;

a flange pivotally mounted on said bracket for mounting on a door;

an adjusting plate having a plurality of bores for passage of mounting elements therethrough into a door; and means for securing said flange to said adjusting plate in releasable manner to allow manual adjustment of said flange relative to said adjusting plate without removal of said flange from said adjusting plate wherein said adjusting plate has a plurality of elongated slots disposed longitudinally of said plate and in parallel relation to each other, said flange has a plurality of bores in alignment with said slots of said adjusting plate and said means includes a plurality of captive nut assemblies, each said captive nut assembly having a nut slidably disposed in a respective one of said slots of said plate and a screw passing through a respective bore of said flange and threadably mounted in said nut.

2. An adjustable hinge as set forth in claim 1 further comprising a cover plate removably mounted on said flange on a side opposite said adjusting plate.

3. An adjustable hinge comprising a bracket for mounting on a door frame;

a flange pivotally mounted on said bracket for mounting on a door;

an adjusting plate having a plurality of bores for passage of mounting elements therethrough into a door;

means for securing said flange to said adjusting plate in releasable manner to allow manual adjustment of said flange relative to said adjusting plate without removal of said flange from said adjusting plate; and a cam assembly mounting said flange on said bracket, said cam assembly including a female cam mounted in said bracket and having a cylindrical bore and a pin secured to said flange and rotatably mounted in said bore of said female cam.

4. An adjustable hinge as set forth in claim 3 wherein said cam is of oval cross-section with a plurality of longitudinal grooves and ribs extending about a part periphery thereof.

5. An adjustable hinge as set forth in claim 4 wherein said cam has a central cylindrical section with said ribs extending outwardly of said central cylindrical section.

6. An adjustable hinge as set forth in claim 5 wherein said ribs are trapezoidal in cross-section.

7. An adjustable hinge as set forth in claim 3 wherein said flange has a hub receiving said pin of said cam assembly in non-rotatable manner and having a predetermined offset from the remainder of said flange.

8. An adjustable hinge as set forth in claim 7 wherein said pin is of plastic material and has a radially extending collar abutting each of said hub and said cam in slide relation.

9. In combination a door frame;

a door disposed within said frame for moving between a closed position and an open position relative to said frame; and at least one adjustable hinge securing said door to said frame for pivoting of said door between said closed position and said open position, said hinge including a bracket mounted on said door frame, an adjusting plate secured to said door, a flange pivotally mounted on said bracket and disposed over said plate and means for securing said flange to said adjusting plate in releasable manner to allow manual adjustment of said door relative to said door frame without removal of said flange from said adjusting plate wherein said adjusting plate has a plurality of elongated slots disposed in parallel relation to each other, said flange has a plurality of bores in alignment with said slots of said adjusting plate and said means includes a plurality of captive nut assemblies, each said captive nut assembly having a nut slidably disposed in a respective one of said slots of said plate and a screw passing through a respective bore of said flange and threadably mounted in said nut for securing said flange to said adjusting plate.

10. The combination as set forth in claim 9 further comprising a cover plate removably mounted on said flange on a side opposite said adjusting plate.

11. In combination a door frame;

a door disposed within said frame for moving between a closed position and an open position relative to said frame;

at least one adjustable hinge securing said door to said frame for pivoting of said door between said closed position and said open position, said hinge including a bracket mounted on said door frame, an adjusting plate secured to said door, a flange pivotally mounted on said bracket and disposed over said plate and means for securing said flange to said adjusting plate in releasable manner to allow manual adjustment of said door relative to said door frame without removal of said flange from said adjusting plate; and a cam assembly mounting said flange on said bracket, said cam assembly including a female cam mounted in said bracket and having a cylindrical bore and a pin secured to said flange and rotatably mounted in said bore of said female cam.

12. The combination as set forth in claim 11 wherein said cam is of oval cross-section with a plurality of longitudinal grooves and ribs extending about a part periphery thereof.

13. The combination as set forth in claim 11 wherein said flange has a hub receiving said pin of said cam assembly in non-rotatable manner and having a predetermined offset from the remainder of said flange.

14. The combination as set forth in claim 11 wherein said pin is of plastic material and has a radially extending collar abutting each of said hub and said cam in slide relation.

15. An adjustable hinge comprising a bracket for mounting on a door frame;

a flange pivotally mounted on said bracket for mounting on a door;

an adjusting plate having a plurality of bores for passage of mounting elements therethrough into a door; and means for securing said flange to said adjusting plate in releasable manner to allow manual adjustment of said flange relative to said adjusting plate without removal of said flange from said adjusting plate wherein said means includes a plurality of captive nut assemblies, each said captive nut assembly having a nut passing through said plate and a screw passing through said flange and threadably mounted in said nut.

16. An adjustable hinge as set forth in claim 15 wherein said adjusting plate has a plurality of elongated slots, each said slot receiving a nut of a respective captive nut assembly.

* * * * *